US012601233B2

(12) United States Patent
Bunney et al.

(10) Patent No.: US 12,601,233 B2
(45) Date of Patent: Apr. 14, 2026

(54) TUBING ANCHOR INCLUDING SLIPS ACTUATED BY SEGMENTED CONE SECTIONS

(71) Applicants: Larry Bunney, Edmonton (CA); Kevin Kelm, Leduc County (CA)

(72) Inventors: Larry Bunney, Edmonton (CA); Kevin Kelm, Leduc County (CA)

(73) Assignee: Triaxis Oil Tools Inc., Calmar (CA)

( * ) Notice: Subject to any disclaimer, the term of this patent is extended or adjusted under 35 U.S.C. 154(b) by 85 days.

(21) Appl. No.: 18/764,255

(22) Filed: Jul. 4, 2024

(65) Prior Publication Data

US 2025/0052121 A1 Feb. 13, 2025

Related U.S. Application Data

(60) Provisional application No. 63/518,937, filed on Aug. 11, 2023.

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 23/03; E21B 23/04; E21B 23/0411
See application file for complete search history.

(56) References Cited

U.S. PATENT DOCUMENTS 2,108,605 A * 2/1938 Moseley ..... E21B 31/20 166/216
2,332,749 A * 10/1943 Page ..... E21B 23/0411 166/212
2,737,242 A * 3/1956 Baker ..... E21B 23/06 166/134
2,878,877 A * 3/1959 Baker ..... E21B 33/12955 166/212
3,391,742 A * 7/1968 Davis ..... E21B 33/1292 166/139
3,608,634 A * 9/1971 Cochran ..... E21B 23/06 166/212

(Continued)

FOREIGN PATENT DOCUMENTS

GB 2108180 A * 5/1983 ..... E21B 23/06

*Primary Examiner* — Steven A MacDonald
(74) *Attorney, Agent, or Firm* — Ryan W. Dupuis; Kyle R. Satterthwaite; Ade & Company Inc.

(57) ABSTRACT

A tubing anchor apparatus has a plurality of slips supported on an inner housing, and a first fixed cone arrangement and a second movable cone arrangement, each of circumferentially spaced cone sections, supported at opposing ends of the slips. The cone sections have working faces sloped radially and longitudinally inwardly towards the slips such that actuating the second cone sections longitudinally towards the first cone sections displaces the slips radially outward to grip the wellbore casing. The cone sections are thus double acting so that the anchor tool both stops the tool from falling down the wellbore should the deployment tubing separate and stops the tool from coming up to allow the tubing to be tensioned. The spaced apart cone sections in lobes protects the slips from catching when inserting or removing from the wellbore, while providing a high-volume annulus flow through between the circumferential spaced cone sections.

18 Claims, 9 Drawing Sheets

(56) References Cited

U.S. PATENT DOCUMENTS 3,631,924 A * 1/1972 McGill ..... E21B 33/1293 166/134
3,631,925 A * 1/1972 Nutter ..... E21B 23/06 166/134
3,645,335 A * 2/1972 Current ..... E21B 33/12 166/120
3,664,417 A * 5/1972 Conrad ..... E21B 23/01 166/216
3,701,382 A * 10/1972 Williams ..... E21B 33/1294 166/183
3,746,093 A * 7/1973 Mullins ..... E21B 33/1293 166/134
3,749,166 A * 7/1973 Young ..... E21B 23/06 166/134
3,976,133 A * 8/1976 Allen ..... E21B 33/1295 166/134
4,044,826 A * 8/1977 Crowe ..... E21B 23/06 166/182
4,216,827 A * 8/1980 Crowe ..... E21B 33/1295 166/182
4,285,400 A * 8/1981 Mullins ..... E21B 33/1295 166/120
4,287,949 A * 9/1981 Lindsey, Jr. ..... E21B 23/0411 166/212
4,393,929 A * 7/1983 Akkerman ..... E21B 33/1295 166/134
4,423,777 A * 1/1984 Mullins ..... E21B 33/1295 166/212
4,423,782 A * 1/1984 Bowyer ..... E21B 33/1294 166/321
4,438,811 A * 3/1984 Patel ..... E21B 33/1293 166/134
4,441,559 A * 4/1984 Evans ..... E21B 33/1295 166/212
RE31,881 E * 5/1985 Lindsey, Jr. ..... E21B 23/042 166/212
4,526,229 A * 7/1985 Dickerson ..... E21B 33/1295 166/120
4,732,212 A * 3/1988 Fraser, III ..... E21B 23/01 166/216
4,754,814 A * 7/1988 Jordan, Jr. ..... E21B 33/1295 166/134
4,862,957 A * 9/1989 Scranton ..... E21B 33/1295 166/134
5,381,862 A * 1/1995 Szarka ..... E21B 34/14 166/212
5,526,884 A * 6/1996 Lembcke ..... E21B 23/01 166/120
5,586,601 A * 12/1996 Pringle ..... E21B 33/1295 166/212
5,704,393 A * 1/1998 Connell ..... E21B 17/06 251/339
5,941,306 A * 8/1999 Quinn ..... E21B 23/06 166/120
6,109,357 A * 8/2000 Zimmerman ..... E21B 34/10 166/387
7,114,573 B2 * 10/2006 Hirth ..... E21B 43/10 166/212
9,810,035 B1 * 11/2017 Carr ..... E21B 23/065
10,760,363 B2 * 9/2020 Tom ..... E21B 23/01
10,920,510 B2 * 2/2021 Egleton ..... E21B 23/0411
11,028,653 B2 * 6/2021 El Mallawany ..... E21B 23/042
11,421,491 B2 * 8/2022 Scruggs ..... E21B 29/00
11,434,710 B2 * 9/2022 Goad, Jr. ..... E21B 43/10
2003/0034159 A1 * 2/2003 Weinig ..... E21B 23/01 166/138
2004/0026092 A1 * 2/2004 Divis ..... E21B 33/128 166/134
2004/0194954 A1 * 10/2004 Cram ..... E21B 23/0411 166/212
2004/0216877 A1 * 11/2004 Pedersen ..... E21B 43/10 166/387
2005/0194151 A1 * 9/2005 Dewey ..... E21B 23/01 166/217
2007/0034370 A1 * 2/2007 Moyes ..... E21B 23/01 166/208
2007/0107913 A1 * 5/2007 Arnold ..... E21B 33/1277 166/387
2010/0252278 A1 * 10/2010 Harris ..... E21B 29/10 166/212
2011/0056676 A1 * 3/2011 Birner ..... E21B 33/1295 166/120
2011/0284208 A1 * 11/2011 Macleod ..... E21B 41/00 166/88.2
2012/0037381 A1 * 2/2012 Giroux ..... E21B 23/01 166/217
2012/0132438 A1 * 5/2012 Telfer ..... E21B 23/06 166/321
2013/0180715 A1 * 7/2013 Harris ..... E21B 23/01 166/208
2013/0299160 A1 * 11/2013 Lott ..... E21B 23/01 166/88.2
2015/0292284 A1 * 10/2015 Lemm ..... E21B 33/1291 166/216
2016/0115762 A1 * 4/2016 O'Dwyer ..... E21B 33/12 166/134
2016/0273287 A1 * 9/2016 Scott ..... E21B 23/00
2017/0234090 A1 * 8/2017 Egleton ..... E21B 23/04
2019/0093449 A1 * 3/2019 Sanchez ..... E21B 33/1285
2019/0226327 A1 * 7/2019 Telfer ..... E21B 23/0411
2021/0140255 A1 * 5/2021 Greci ..... E21B 23/065
2022/0389796 A1 * 12/2022 Low ..... E21B 17/06

* cited by examiner

TUBING ANCHOR INCLUDING SLIPS ACTUATED BY SEGMENTED CONE SECTIONS

This application claims the benefit under 35 U.S.C. 119(e) of U.S. provisional application Ser. No. 63/518,937, filed Aug. 11, 2023.

FIELD OF THE INVENTION

The present invention relates to a tubing anchor for anchoring a tubing string relative to a wellbore casing, and more particularly the present invention relates to a tubing anchor having radially movable slips that selectively engage the casing to anchor the tubing string relative to the casing, in which the slips are actuated by cone members supported at longitudinally opposed positions relative to the slips with working faces forming part of a cone to engage opposing ends of the slips and urge the slips into gripping contact with the wellbore when the cone members are displaced towards one another.

BACKGROUND

In hydrocarbon production from a wellbore, there are many wellbore operations in which it is desirable to anchor a tubing string in fixed relationship to a surrounding casing of the wellbore. A typical tubing anchor tool includes a central housing arranged to be connected in line with the tubing string and a plurality of circumferentially spaced apart slips which are movable relative to the central housing to vary an overall diameter of the anchor tool for gripping the surrounding wellbore casing when the slips are displaced radially outward into engagement with the casing.

U.S. Pat. No. 2,735,497 by Brumleu and U.S. Pat. No. 2,532,418 by Page describe two examples of a tubing anchor tool in which a set of slips are displaced longitudinally upward along ramped surfaces of a cone member to displace the slips radially outward into engagement with the casing. In this instance, there is no method of protection from the slips catching the casing while going into the wellbore such that the tool can be prematurely engaged into a locked condition. Furthermore, once deployed, the slips primarily act to only prevent the tubing string from falling down the wellbore, and are unable to fix the tubing string relative to the casing when upwardly tensioning of the tubing string. In addition, the ramped surfaces of the tools are formed as part of a unitary collar structure that occupies a significant amount of space within the annulus between the central tubular housing of the tool and the surrounding casing in a manner that impedes flow within the surrounding annulus as well as impeding the ability to run additional equipment such as injection lines or communication lines through the annulus alongside the tool.

SUMMARY OF THE INVENTION

According to one aspect of the invention there is provided a tubing anchor apparatus for anchoring a tubing string relative to a surrounding casing in a wellbore, the apparatus comprising:

an inner housing having a through passage extending longitudinally between opposing ends of the inner housing, the opposing ends being configured for connecting the inner housing inline with the tubing string such that the through passage communicates with an inner passage of the tubing string;

a plurality of slips supported on the inner housing so as to be radially movable relative to the inner housing;

a first cone arrangement comprising a plurality first cone sections supported at circumferentially spaced positions about the inner housing in alignment with the plurality of slips respectively, each first cone section being fixed relative to the inner housing, and each first cone section having a working face which is sloped radially inwardly while extending in a first longitudinal direction towards the slips;

a second cone arrangement comprising a plurality of second cone sections supported at circumferentially spaced positions about the inner housing in alignment with the plurality of slips respectively, each second cone section having a working face which is sloped radially inwardly while extending in a second longitudinal direction towards the slips such that each slip is received longitudinally between a respective one of the first cone sections and a respective one of the second cone sections;

wherein the second cone sections of the second cone arrangement are actuatable for displacement along the inner housing from a stored position at a first distance from the first cone sections of the first cone arrangement to a working position at a second distance from the first cone sections in which the second distance is less than the first distance; and wherein the working faces of the first and second cone sections engage respective first and second ends of the respective slips to displace the slips radially outward from the stored position defining a first overall diameter of the apparatus to the working position defining a second overall diameter of the apparatus, said second overall diameter being greater than said first overall diameter for gripping the casing in the working position.

The use of opposing first and second cone sections ensures that the slips according to the present invention are double acting so that the anchor tool both (i) stops the tool from falling down the wellbore should the deployment tubing separate and (ii) stops the tool from coming up the wellbore causing the tubing to be anchored in the set position allowing the tubing to be put into tension, for example during pumping operations to remove any slack.

Preferably the cone sections of at least one of the first and second cone arrangements are fully segmented from one another as separate members which are circumferentially spaced apart from one another about the inner housing.

Preferably the first cone sections are fixed relative to the inner housing by release shear pins having a prescribed shear resistance, in which the release shear pins are arranged to shear and release the first cone sections for longitudinal sliding relative to the inner housing upon application of a longitudinal force to the apparatus which exceeds the prescribed shear resistance of the release shear pins.

The first cone sections may be connected to one another by a retainer shear ring supported about the inner housing for longitudinal sliding along the inner housing, the release shear pins being mounted between the retainer shear ring and the inner housing to fix the first cone sections relative to the inner housing.

The first cone arrangement is below the second cone arrangement, wherein upon release of the release shear pins, the first cone sections are slidably downwardly away from the second cone arrangement in the working position.

The apparatus preferably further comprises an outer housing supported about the inner housing, the outer housing receiving the slips, the working faces of the first cone sections and the working faces of the second cone sections therein, wherein the outer housing comprises (i) a sleeve portion arranged to be supported about the inner housing and (ii) a plurality of lobes protruding radially outwardly from the sleeve portion at circumferentially spaced apart positions about the sleeve portion, and wherein each lobe defines a longitudinal guideway receiving: (i) a respective one of the slips therein, (ii) the working face of the respective first cone section therein, and (iii) the working face of the respective second cone section therein.

The additional use of an outer housing or cage surrounding the slips provides protection from the slips catching while lowering the tubing string into the wellbore so as to prevent premature setting of the tool. More particularly, by use of a segmented cone surfaces within respective guideways in the lobes of the outer housing or cage, together with a positive engagement of the split cones to an energizing mechanism on the hydraulic piston side and a positive engagement to the shear pin coupling on the opposing side, the slip arrangement is protected from catching on the run in while also ensuring that all of the pieces remain intact during the retrieval process.

The apparatus may be further configured such that (i) each guideway of the outer housing includes a pair of longitudinally opposed internal shoulder surfaces in which the working faces of the respective first and second cone sections are longitudinally contained between the opposed internal shoulder surface, and (ii) the opposed internal shoulder surfaces being spaced apart by a prescribed longitudinal direction enabling relative movement of the first and second cone sections between the stored position and the working position. The outer housing is preferably longitudinally slidable relative to the inner housing. Preferably each slip is fully retracted radially relative to the respective lobe of the outer housing receive the slip therein in the stored position.

The arrangement of the slips comprising fully separated cone sections operated within respective lobes of the outer housing or cage also results in a configuration where considerable open space is provided in the annular between the slips in the circumferential direction even when the slips are engaged with the casing in use. This enables the annulus to receive a high volume of flow through the annulus between the anchor and the surrounding wellbore casing, for example when using a gas separator which diverts a high flow of fluid and gas up the annulus while producing hydrocarbons through the tubing string. The large space in the annulus between the slips also readily allows for chemical injection (corrosive inhibitors), electrical lines, fibre optics lines, and the like to be inserted through the annulus past the anchor when set without interference to the operation of the anchor. This provides the tool with the further ability to flush the tool with fluid such as Hot Oiling to remove any accumulated debris or paraffin wax, and the like, that may interfere with the removal of the tool from the wellbore.

Each slip may be operatively connected to a respective spring member supported under radial compression to bias the slip radially inwardly towards the stored position.

When the first cone arrangement is supported below the second cone arrangement, the second cone sections are preferably slidably downwardly towards the first cone arrangement from said first distance in the stored position to said second distance in the working position.

The second cone sections are preferably connected to one another by a retainer ring supported about the inner housing for longitudinal sliding along the inner housing. Each second cone section may further include a distal end longitudinally opposed from the working face of the second cone section in which the retainer ring extending externally about the distal ends of the second cone sections.

The apparatus may further comprise a piston assembly supported externally about the inner housing and including said retainer ring connecting the second cone sections such that the piston assembly and the second cone sections are movable together along the inner housing, wherein the piston assembly defines a fluid cavity therein in fluid communication with the through passage of the inner housing, and wherein the fluid cavity of the piston assembly expands as the second cone sections are displaced with the piston assembly from the stored position to the working position whereby the piston assembly is hydraulically actuated by pressurized fluid in the through passage of the inner housing.

The piston assembly may be fixed relative to the inner housing in the stored position by actuating shear pins having a prescribed shear resistance, in which the actuating shear pins are arranged to shear and release the piston assembly from the stored position for longitudinal sliding relative to the inner housing upon application of a prescribed fluid pressure to the through passage of the inner housing which exceeds the prescribed shear resistance of the actuating shear pins.

The apparatus may further comprise: (i) a piston assembly supported externally about the inner housing and connected to the second cone sections such that the piston assembly and the second cone sections are movable together along the inner housing; and (ii) a lock collar operatively connected between the piston assembly and the inner housing, the lock collar enabling sliding movement of the piston assembly in a first direction corresponding to displacement of the second cone sections towards the first cone sections from the stored position to the working position, and the lock collar preventing sliding movement of the piston assembly in a second direction corresponding to displacement of the second cone sections away from the first cone sections from the working position towards the stored position.

The lock collar may comprise a split ring arranged to be constricted about the inner housing in response to displacement of the piston assembly away from the working position towards the stored position.

The lock collar may comprise at least one annular member protruding radially from the split ring, in which said at least one annular member has a ramped surface that is sloped longitudinally away from the first cone sections as the ramped surface extends radially outward, and in which the ramped surface of said at least one annular member is arranged to cooperate with a corresponding ramped surface on the piston assembly such that relative sliding movement between the ramped surface on said at least one annular member and the corresponding ramped surface on the piston assembly acts to constrict the split ring about the inner housing to lock the piston assembly relative to the inner housing in response to displacement of the piston assembly away from the working position towards the stored position.

The at least one annular member may comprise a helical thread extending about the split ring, in which a corresponding thread is provided on the piston assembly in threaded connection with the helical thread in which said corresponding ramped surface is defined on the corresponding thread on the piston assembly.

Although the illustrated embodiment provides a configuration for hydraulically setting the anchor from the stored position to the working position, the configuration of the slips cooperating with segmented cone sections within guideways in the lobes of a surrounding outer housing or cage could also be actuated mechanically in further embodiments.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
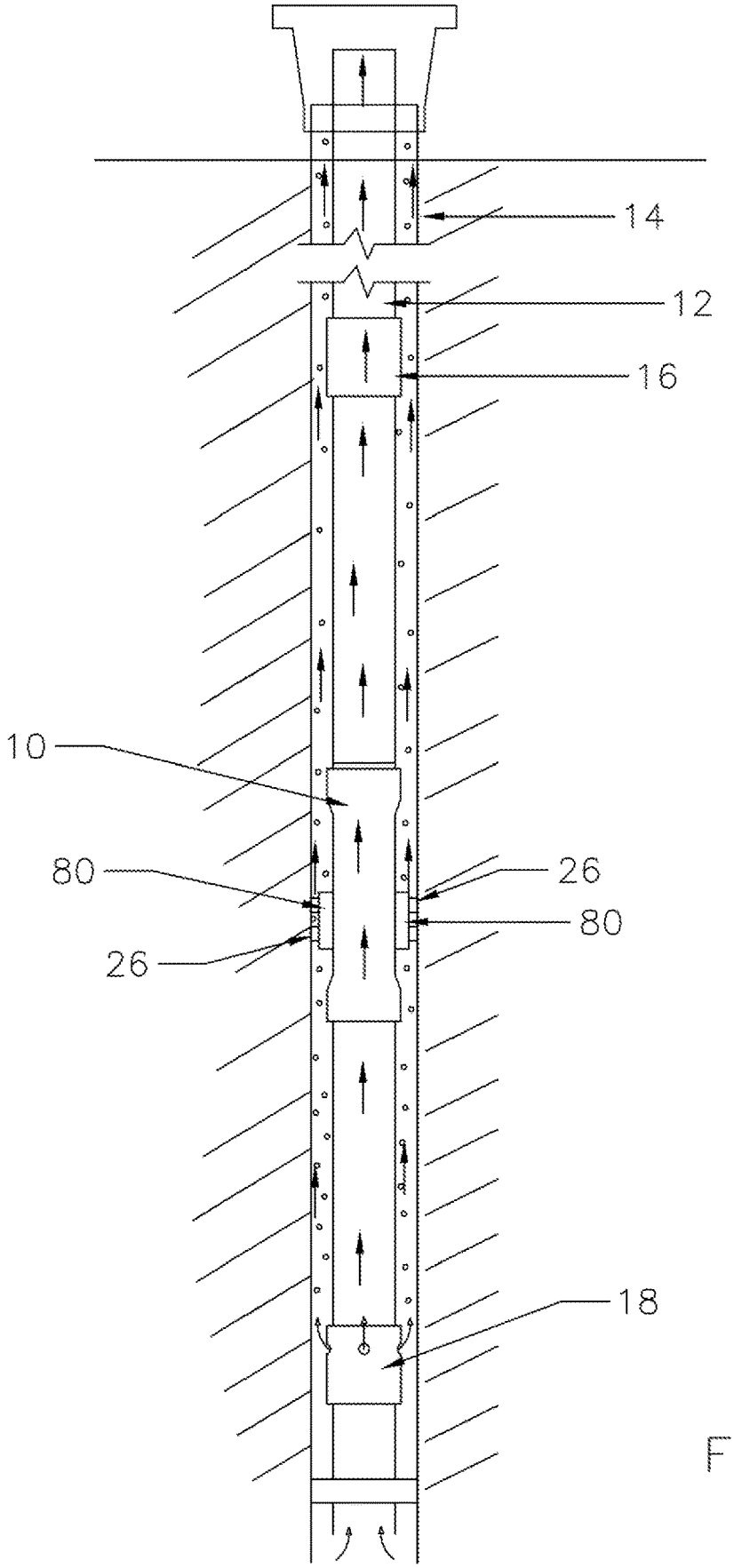
FIG. 1 is a schematic representation of the anchor apparatus mounted on a tubing string within a wellbore.
Figure 2:
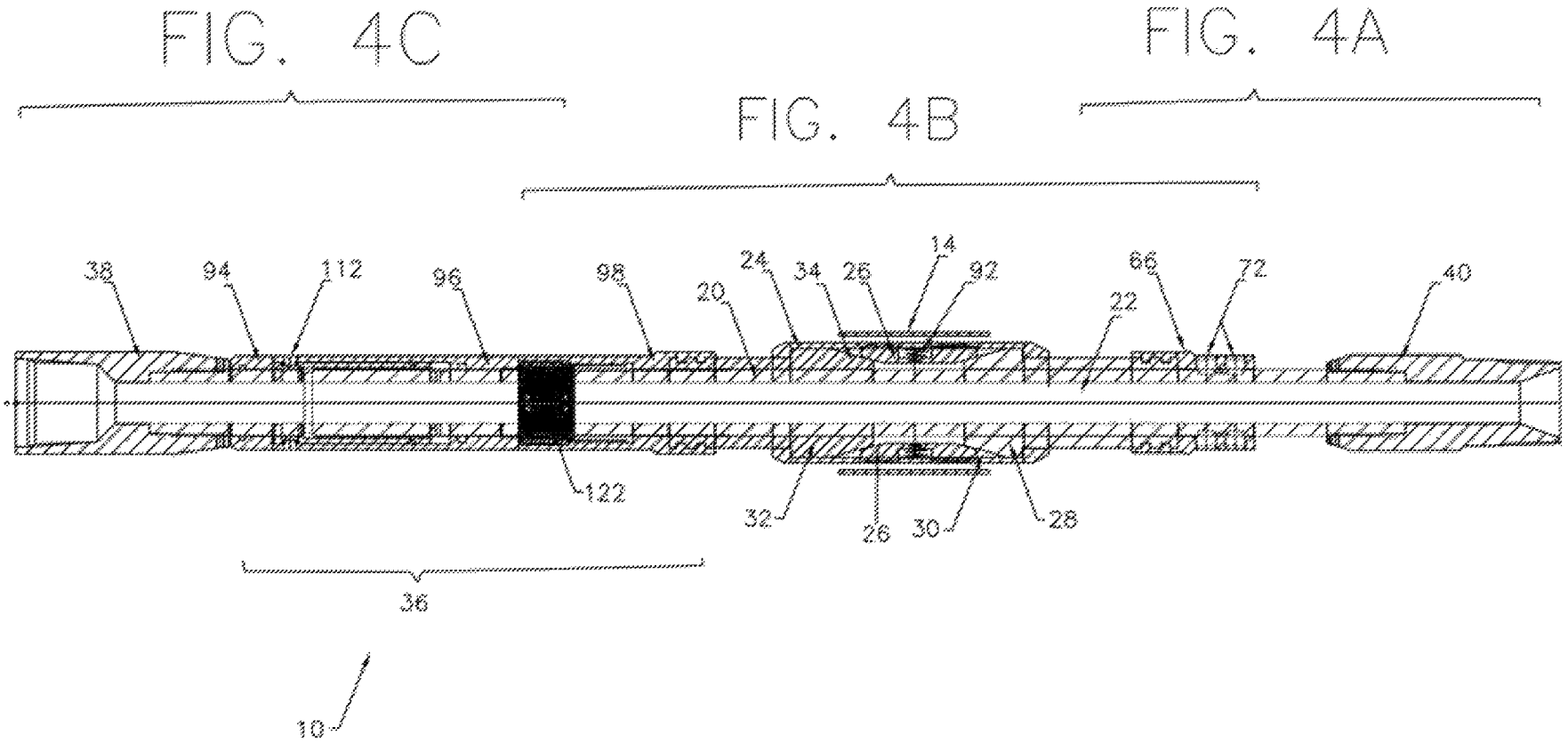
FIG. 2 is a sectional view of the apparatus, along the line 2-2 in FIG. 3.
Figure 3:
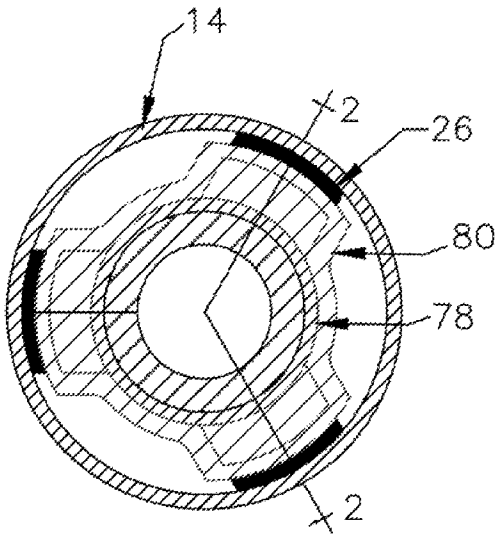
FIG. 3 is a partly sectional end view of the apparatus shown in the working position within a surrounding wellbore casing.
Figure 4A:
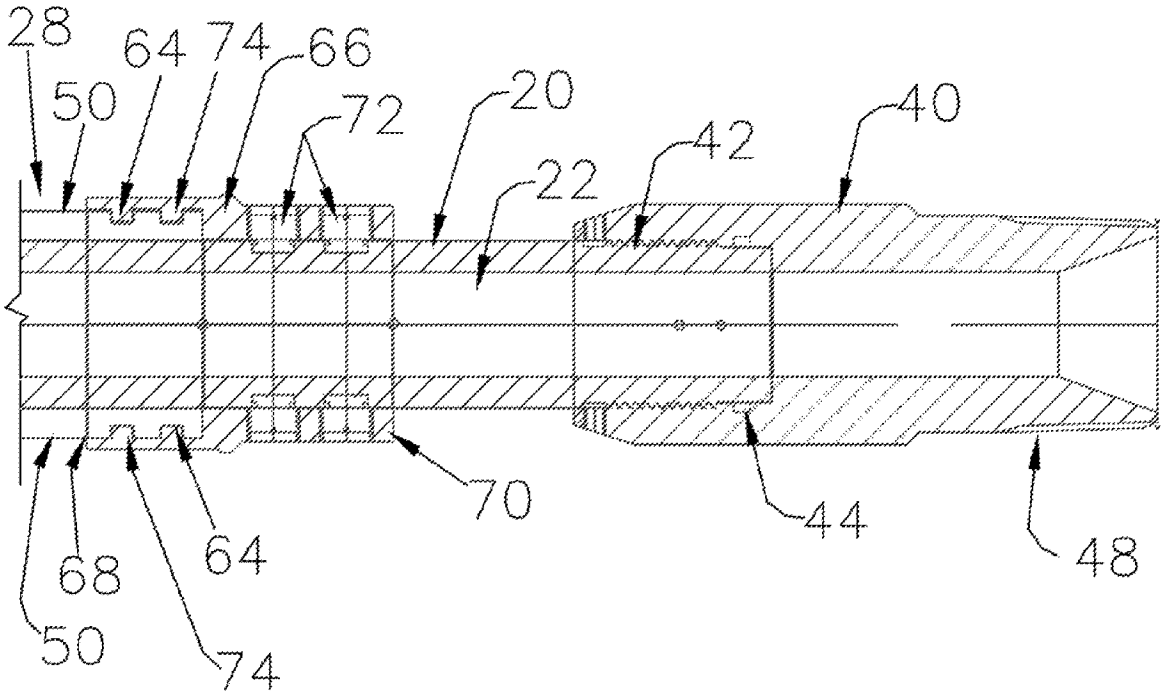
FIGS. 4A, 4B and 4C are enlarged sectional views of respective portions of the apparatus according to the sectional view of FIG. 2.
Figure 4B:
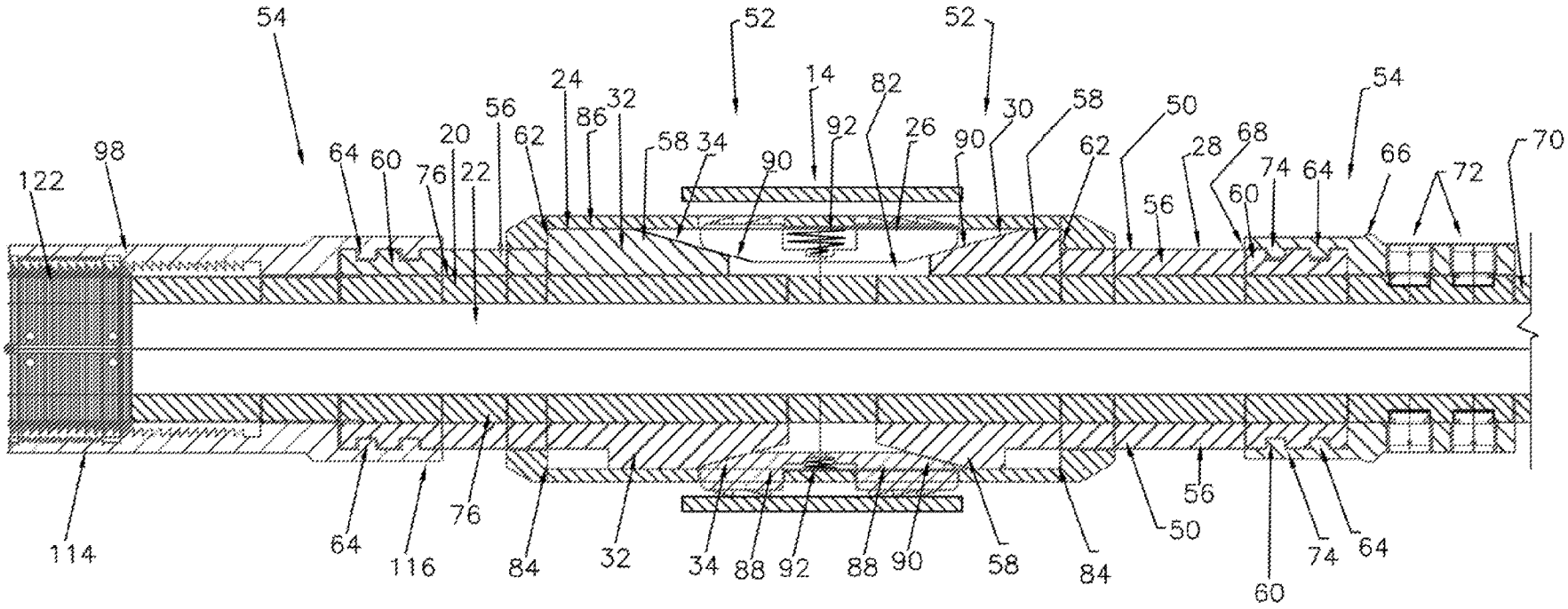
Figure 4C:
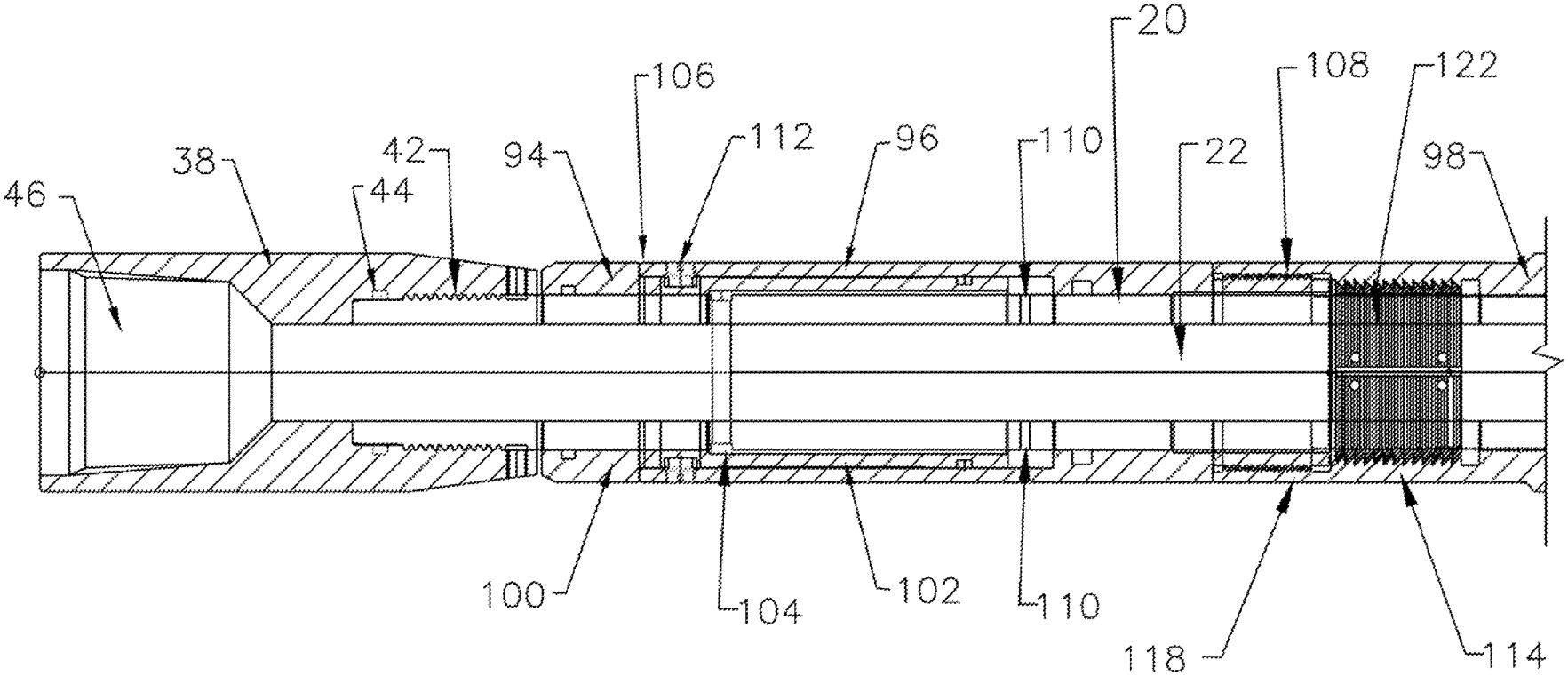
Figure 5:
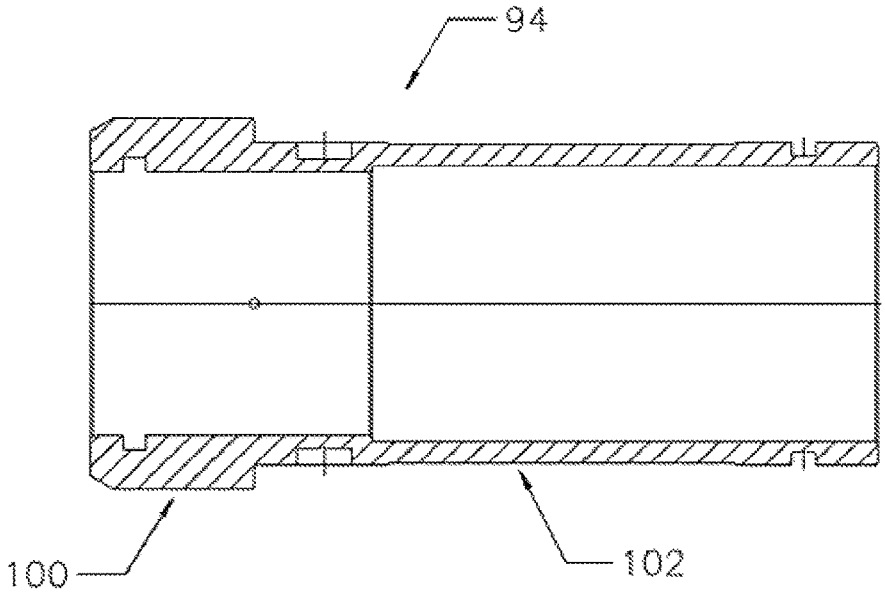
FIG. 5 is a sectional view of the piston portion of the hydraulic piston actuating assembly of the apparatus.
Figure 6:
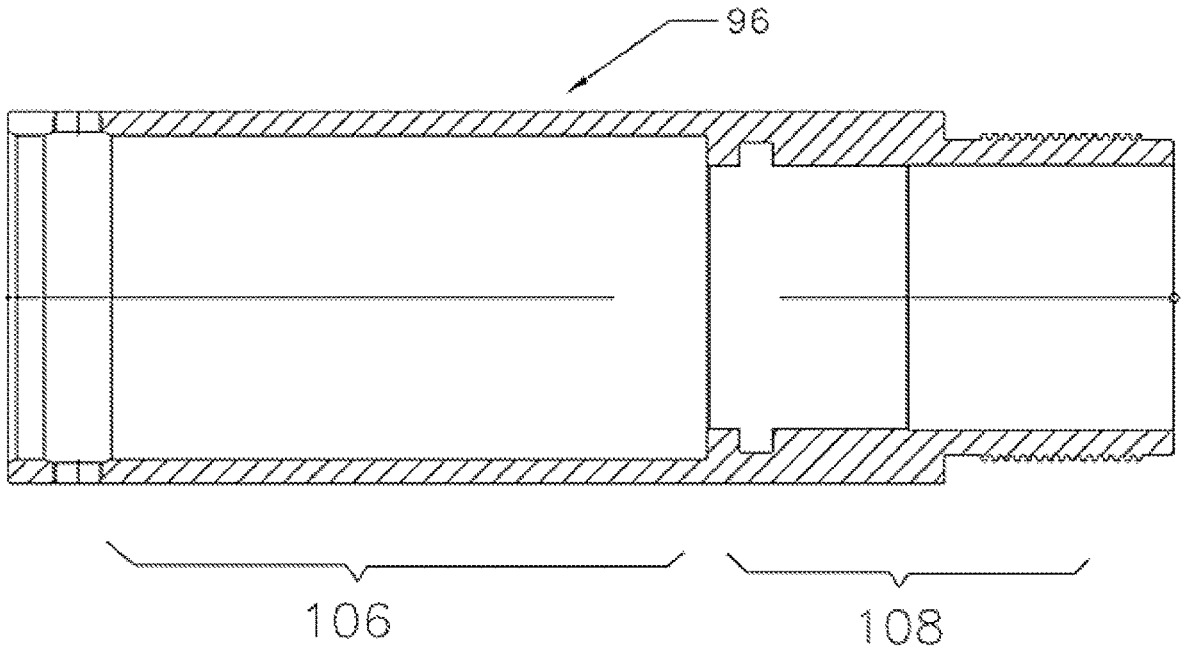
FIG. 6 is a sectional view of the piston housing portion of the hydraulic piston actuating assembly of the apparatus.
Figure 7:
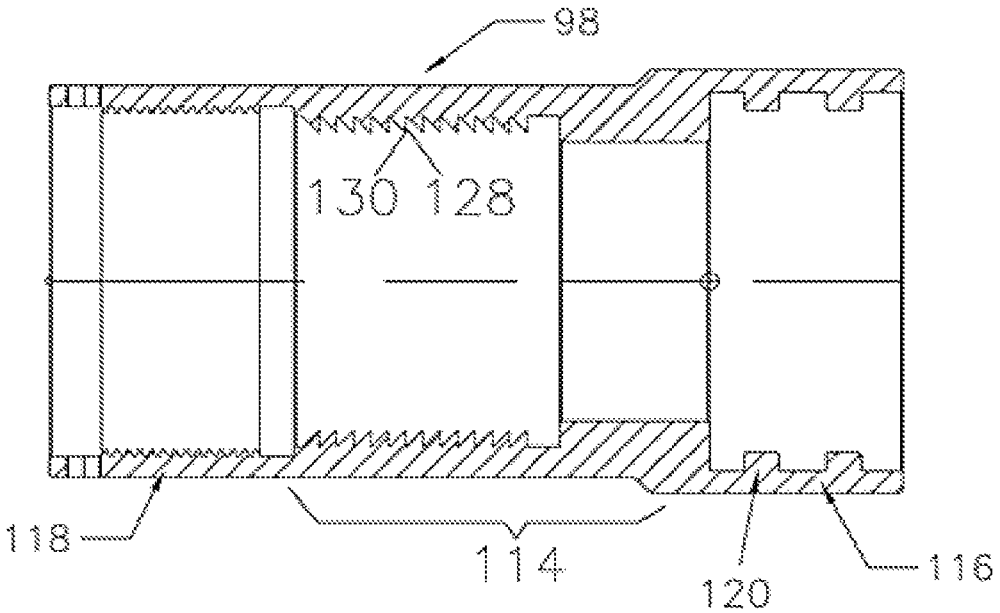
FIG. 7 is a sectional view of the upper retainer housing of the apparatus.
Figure 8:
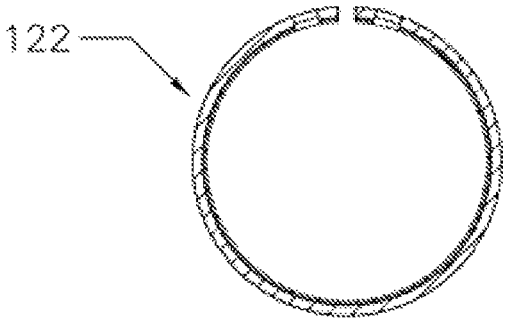
FIG. 8 is an end view of the split ring lock collar of the apparatus.
Figure 9:
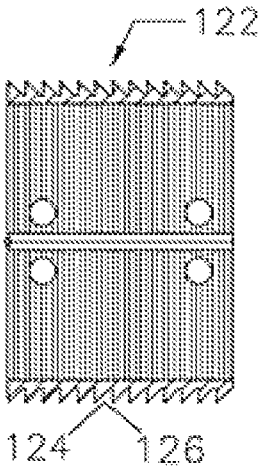
FIG. 9 is a sectional view of the split ring lock collar.
Figure 10:
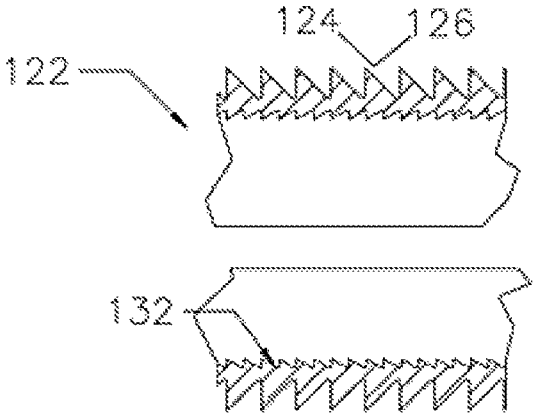
FIG. 10 is an enlarged sectional view of the split ring lock collar.
Figure 11:
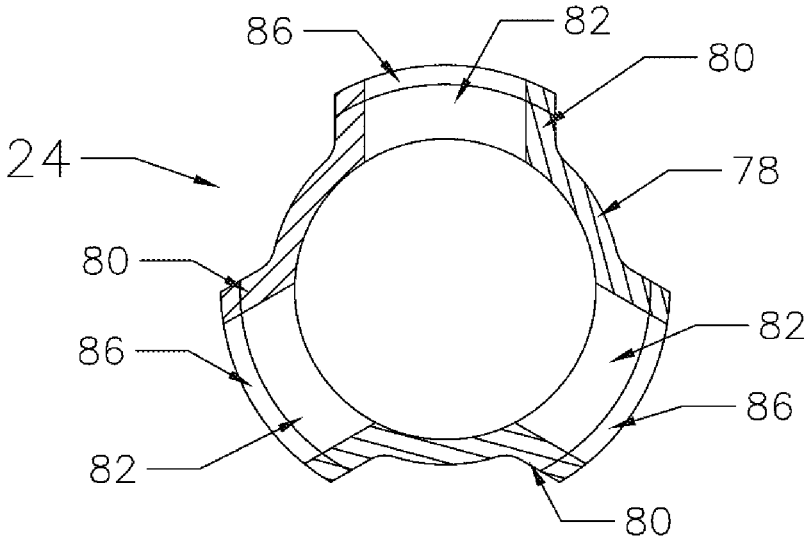
FIG. 11 is a sectional view of the outer housing that supports the slips therein.
Figure 12:
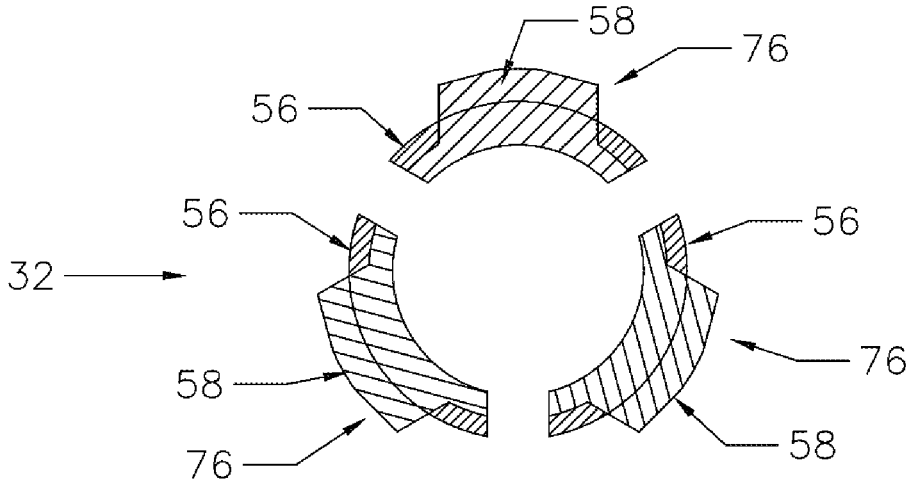
FIG. 12 is a sectional view of the upper cone sections of the upper cone arrangement of the apparatus.
Figure 13:
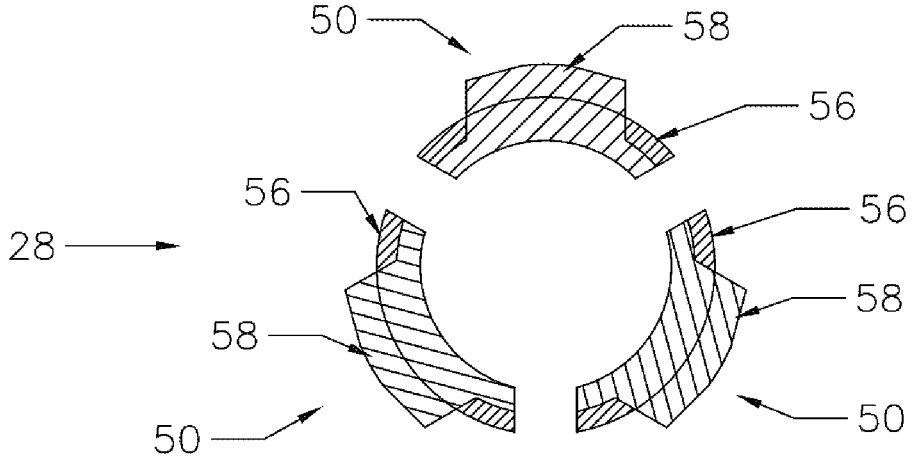
FIG. 13 is a sectional view of the lower cone sections of the lower cone arrangement of the apparatus.
Figure 14:
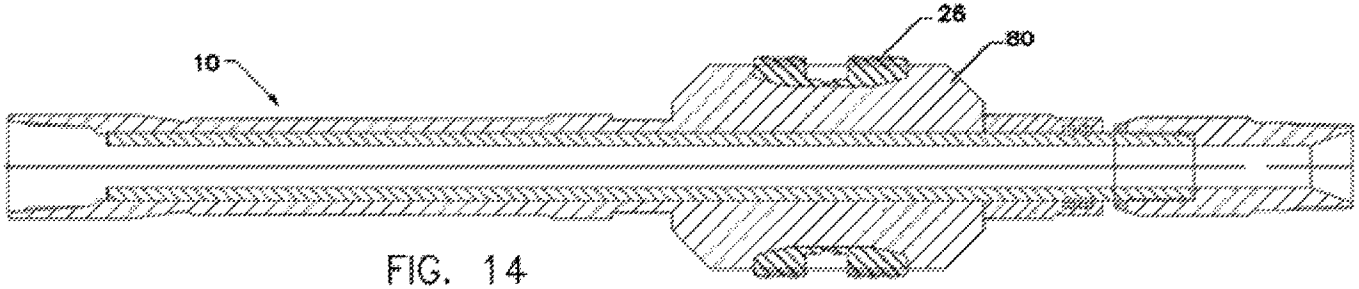
FIGS. 14 and 15 are longitudinal cross section and end views respectively of an alternate embodiment of the anchor apparatus.
Figure 16:
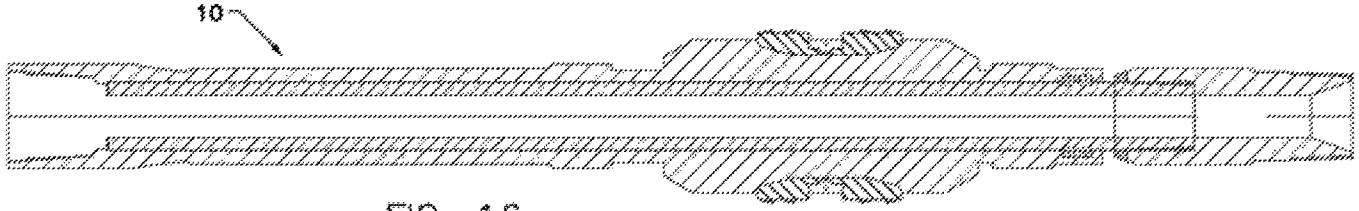
FIGS. 16 and 17 are longitudinal cross section and end views respectively of an alternate embodiment of the anchor apparatus.
Figure 18:
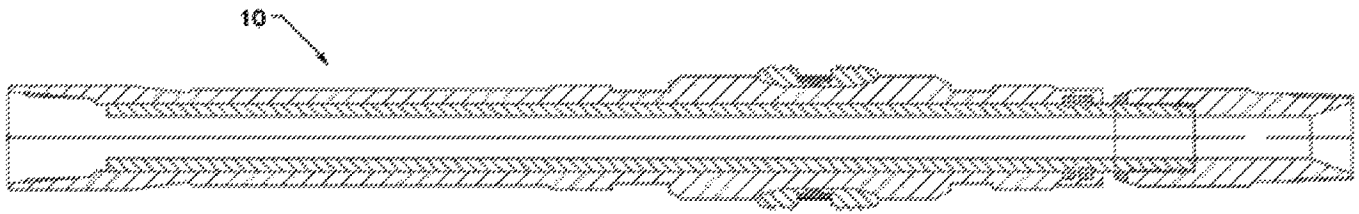
FIGS. 18 and 19 are longitudinal cross section and end views respectively of an alternate embodiment of the anchor apparatus.
Figure 15:
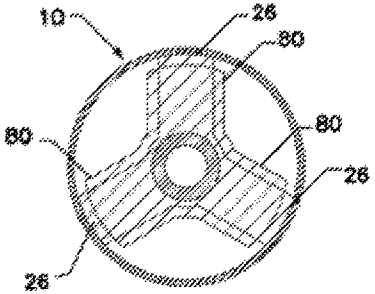
Figure 17:
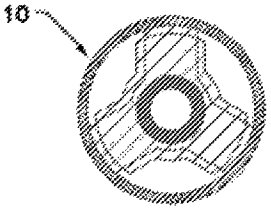
Figure 19:
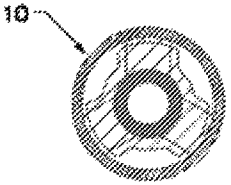

Referring to the accompanying figures there is illustrated a tubing anchor apparatus generally indicated by reference numeral 10. The apparatus 10 is particularly suited for use with a tubing string 12 that is suspended from a wellhead within the outer casing 14 of a wellbore for producing hydrocarbons.

In an exemplary use of the apparatus 10, the apparatus is connected in line with the tubing string 12 to be lowered into the wellbore casing 14 together with the tubing string. A pump 16 is also connected in line with the tubing string to pump hydrocarbon fluids produced from the wellbore upwardly through the tubing string. A gas separator 18 may be connected at the bottom end of the tubing string 12 such that gas within the produced fluids is diverted into an annulus space between the tubing string and the surrounding casing while remaining produced fluids are directed upwardly through the tubing string.

The tubing anchor apparatus 10 is operable between (i) a stored position defining a first overall diameter of the apparatus which is smaller than the interior diameter of the outer casing 14 to allow the apparatus 10 to be displaced into and out of the casing together with the tubing string, and (ii) a working position defining a second overall diameter of the apparatus which is greater than the first overall diameter and which is equal to or greater than the interior diameter of the outer casing to enable the apparatus to engage the outer casing and secure the apparatus in fixed relation to the outer casing for anchoring the tubing string relative to the casing.

The apparatus 10 generally includes (i) an inner housing 20 arranged to be connected in line with the tubing string such that an inner passage 22 extending longitudinally through the inner housing openly communicates with the tubing string above and below the apparatus, (ii) an outer housing 24 supported about the inner housing 20 at an intermediate location for supporting a plurality of slips 26 at circumferentially spaced positions about the inner housing such that the slips are movable generally radially to vary the overall diameter of the apparatus between the stored and working positions, (iii) a lower cone arrangement 28 supported below the slips 26 and having working faces 30 received inside the outer housing to cooperate with corresponding surfaces on the slips 26 to urge the bottom ends of the slips 26 into the working position when actuated, (iv) an upper cone arrangement 32 supported above the slips and having working faces 34 received inside the outer housing to cooperate with corresponding surfaces on the slips 26 to urge the top end of the slips into the working position when actuated, and (v) a piston assembly 36 supporting the upper cone arrangement 32 for longitudinal displacement relative to the lower cone arrangement 28 to actuate the slips 26 from the stored position to the working position as described in further detail below.

The inner housing 20 is an elongate tubular member extending in the longitudinal direction of the tubing string between a top end for connection to a top sub and a bottom and for connection to a bottom sub 40. The inner passage 22 of the inner housing has a constant diameter along the length thereof between open top and bottom ends in open communication with the interior passage of the tubing string above and/or below the apparatus 10. Both ends of the inner housing 20 are externally threaded for forming a threaded connection with corresponding internally threaded sockets 42 at the innermost end of both the top and bottom subs. Each socket 42 may further include an annular groove 44 therein for receiving a suitable O-ring to provide a sealing connection between the inner housing and the sub. The opposing top end of the top sub includes an internally threaded socket 46 for forming a threaded connection with the bottom end of a respective section of the tubing string immediately above the apparatus 10. The opposing bottom end of the bottom sub includes an externally threaded portion for forming a threaded connection with the top end of a respective section of the tubing string immediately below the apparatus 10.

The lower cone arrangement 28 is suitably configured to remain fixed and immovable relative to the inner housing 20 during displacement of the upper cone arrangement from the storage position to the working position to actuate the tool; however, the lower cone arrangement 28 remains releasable from the inner housing 20 in the working position to release the anchor from the outer casing when it is desired to remove the apparatus from the wellbore. The lower cone arrangement 28 comprises three lower cone sections 50 which are supported at evenly spaced apart positions about the circumference of the inner housing 20 while being fully segmented and spaced apart from one another as distinct and separate bodies. Each lower cone section extends in a longitudinal direction of the tubing string between a proximal end in close proximity to the slips 26 and an opposing distal end 54 configured for being connected to the inner housing within the interior of the outer housing 54 at a location externally of the outer housing 24.

More particularly, each lower cone section 50 includes a main body portion 56 extending longitudinally along a majority of the overall length of the cone section between an actuating body portion 58 that cooperates with the slips at the proximal end 52 within the interior of the outer housing 24 and a mounting body portion at the distal end 54 to form a connection of the cone section relative to the inner housing to control the longitudinal position of the cone section relative to the inner housing.

The main body portion 56 of each lower cone section 50 is elongate in the longitudinal direction and has a width in the circumferential direction and between 90° and 110° about the inner housing so as to remain spaced apart in the circumferential direction from the other cone sections. The inner surface of the main body portion 56 has a radius of curvature that is approximately equal to the radius of curvature of the outer surface of the inner housing so that the inner surface of the main body portion mates with the outer surface of the inner housing to guide longitudinal sliding movement of the main body portion along the inner housing.

The actuating body portion 58 of each lower cone section 50 is enlarged in radius relative to the main body portion to define a step along the outer surface of the cone section from the actuating body portion 58 to the main body portion 56 defining a catch 62 which is perpendicular to the longitudinal direction and which faces longitudinally outward towards the distal end 54 of the cone section. The actuating body portion 58 also defines the working face 30 thereon which is sloped so as to face partly radially outward and partly longitudinally towards the proximal end 52 of the cone section. More particularly, the working face 30 is sloped to extend in the longitudinal direction towards the slips 26 while extending radially inward with reducing radial dimension. In this manner, the working face 30 functions like a cam surface to urge the slip radially outward as the cone sections 50 are displaced longitudinally inward towards one another.

The mounting body portion 60 is defined by a plurality of circumferentially extending grooves 64 formed in the outer surface of the cone section to define one or more ribs between the grooves 64 having annular surfaces formed thereon that are perpendicular to the longitudinal direction for cooperation with corresponding surfaces on other components of the apparatus 10 to control the longitudinal position of the cone sections as described in further detail below.

A retainer shear ring 66 of the apparatus 10 is mounted externally about the distal end of the lower cone sections 50 in cooperation with the grooves 64 of the mounting body portion 60. The retainer shear ring 66 is an elongate sleeve having a proximal end 68 having an inner diameter that is enlarged relative to the inner housing to receive the distal ends of the lower cone sections inserted between the proximal end of the retainer shear ring 66 and the outer diameter of the inner housing in the radial direction. An opposing distal end 70 of the retainer shear ring has an interior diameter that closely matches the outer diameter of the inner housing to support the retainer shear ring for longitudinal sliding along the inner housing.

In order to fix the lower cone sections 50 immovably relative to the inner housing as the tool is operated from the stored position to the working position, a plurality of release shear pins 72 are provided at circumferentially spaced positions to couple the retainer shear ring 66 to the inner housing 20. The release shear pins 72 may be provided with a prescribed line of weakness forming a shear plane that is aligned with the intersection between the inner surface of the retainer shear ring and the outer surface of the inner housing such that shearing of the shear pins 72 at the shear plane releases the retainer shear ring 66 and the lower cone sections 50 coupled thereto for longitudinal sliding along the inner housing 20. The release shear pins 72 are configured to define a prescribed holding force which fixes the lower cone sections relative to the inner housing 20 until a longitudinal force is applied to the release shear pins 72 by upward pulling on the tubing string with a force that exceeds the prescribed holding force to result in shearing of the pins.

The proximal end 68 of the retainer shear ring includes ribs 74 which protrudes radially inward from the inner diameter of the retainer shear ring in alignment with the grooves 64 in the mounting body portion of the lower cone sections such that the mating connection between the ribs 74 of the retainer shear ring and the grooves of the lower cone sections couples the lower cone sections to the retainer shear ring for longitudinal sliding movement together along the inner housing.

In the working position, the release shear pins 72 fixes the lower cone arrangement and the retainer shear ring 66 relative to the inner housing at a location spaced above the lower sub 40 by a sufficient distance that releasing of the shear pins enables the lower cone sections 50 to be displaced downwardly along the inner housing from the working position of the slips by a sufficient distance that the longitudinal spacing between the upper and lower cone arrangements enables the slips to return to their minimum overall diameter and thereby release the anchor apparatus from the casing for retrieval of the apparatus from the wellbore. That is the lower cone arrangement can move downwardly by a longitudinal distance that is equal to or greater than the longitudinal distance that the upper cone section is displaced from the storage position to the working position.

The upper cone arrangement 32 is configured substantially identically to the lower cone arrangement in that the upper cone arrangement comprises three upper cone sections 76 which are fully segmented from one another as separate bodies which are circumferentially spaced apart and which extend in a longitudinal direction between proximal ends 52 adjacent to the slips 26 and distal ends 54 arranged for connection to the inner housing 20, in this instance through the piston assembly 36 described in further detail below. Each upper cone section 76 is substantially identical to the corresponding lower cone sections so as to similarly comprise (i) a main body portion extending longitudinally between (ii) an actuating body portion 58 at the proximal end 52 that defines the working face 34 and a catch 62 thereon and (iii) a mounting body portion 60 at the distal end 54 with circumferentially extending grooves 64.

The outer housing 24, also described herein as a cage, generally includes (i) a sleeve portion 78 having an inner diameter which closely fits about the outer diameter of the inner housing 20 to support the outer housing for longitudinal sliding along the inner housing, and (ii) a set of three lobes 80 which protrude radially outward from the sleeve portion 78 at evenly spaced apart positions about the circumference of the sleeve portion. Each lobe 80 is elongated in the longitudinal direction of the inner housing 20 and includes an internal cavity therein that is open to the interior and that is similarly elongated in the longitudinal direction to define an internal guideway 82. The internal guideway terminates at longitudinally opposed internal shoulder surfaces 84 that are perpendicular to the longitudinal direction at the opposing ends of the guideway 82.

Each guideway 82 receives the actuating body portion 58 of one of the upper cone sections 76 at the top end thereof, the actuating body portion 58 of one of the lower cone sections 50 at the bottom end thereof, and one of the slips 26 between the upper and lower cone sections. The actuating body portion 58 of the upper cone section 76 is restricted from removal from the outer housing in the longitudinal direction by the catch 62 engaging the internal shoulder surface 84. Similarly, the actuating body portion 58 of the lower cone section 50 is restricted from removal from the outer housing in the longitudinal direction by the catch 62 engaging the opposing internal shoulder surface 84. The internal shoulder surfaces 84 are longitudinally spaced apart by a sufficient distance to allow the upper and lower cone sections to be displaced longitudinally relative to one another by a sufficient distance to receive the slips 26 therebetween in the stored position. The radial dimension of the guideway is also sufficient to allow the slip 26 to be fully retracted in the radial direction into the interior of the outer housing relative to the outermost surface of the lobe 80 in the stored position.

The outer wall 86 at the radially outermost boundary of the lobe 80 has two longitudinally spaced apertures formed therein which receive two end portions 88 of the respective slip received therethrough in the working position. More particularly, each slip 26 extends in the longitudinal direction at the outer side between two end portions 88 which are longitudinally spaced apart for alignment with the corresponding apertures in the outer wall 86. The radially outermost surface of each end portion 88 is textured with suitable ribs or teeth to define an outer gripping face that engages and grips the inner surface of the wellbore casing in the working position. A bridge portion of the slip extends between the end portions 88 and is recessed radially inward relative to the end portions in the radial direction.

At the radially innermost side of each slip, the opposing end portions 88 of the slip are provided with sloped faces 90 which cooperate with the working faces 34 and 30 of the upper and lower cone sections respectively. The sloped faces 90 of each slip extend longitudinally outward and away from one another at a radially outward slope that matches the slope of the corresponding working faces of the cone sections.

A spring member 92 is mounted under radial compression between the outer wall 86 of the lobe at a central location between the two apertures therein and the bridge portion of the slip between the end portions 88. The spring member 92 thus acts to bias the slip inwardly from the working position to the stored position in the absence of cone sections engaged with the slip that force the slip into the working position. The spring biasing force of the spring member 92 is readily overcome by the cone sections when the cone sections are displaced from the stored position to the working position to set the anchor apparatus relative to the casing.

The piston assembly 36 generally includes (i) a piston 94 that is fixedly mounted relative to the inner housing at a location spaced above the cone sections and the outer housing 24, (ii) a piston housing 96 that fits over the piston 94 and the inner housing for longitudinal sliding along the inner housing while defining an expandable piston cavity between the piston 94 and the piston housing 96, and (iii) a retainer housing 98 coupled to the distal ends of the upper cone sections 76 similarly to the function of the retainer shear ring 66 but for coupling the upper cone sections relative to the piston housing 96.

The piston 94 is an elongated sleeve which extends over the inner housing. A head 100 of the piston has an interior diameter approximately equal to the outer diameter of the inner housing 20 and is located at the distal end immediately adjacent the top sub 38. A piston portion 102 of the piston 94 extends longitudinally from the head 100 towards the slips 26 while having a reduced outer diameter relative to the head 100. In addition, the inner diameter of the piston portion is slightly increased relative to the inner diameter of the head and the outer diameter of the inner housing. A split retainer ring 104 is mounted into an external groove on the inner housing 20 at the transition between the head 100 and the piston portion 102 of the piston 94 before mounting of the piston onto the inner housing. The split retainer ring 104 fits within the enlarged inner diameter of the piston portion 102 so that the piston portion can be inserted downwardly over top of the split retainer ring during assembly. Once assembled, the head 100 of the piston is fixed in the longitudinal direction between the top sub 38 above the piston 94 and the split retainer ring 104 that engages the internal shoulder at the transition between the head 100 and the piston portion 102 so that the piston 94 is fixed and immovable relative to the inner housing 20.

The piston housing 96 is also a sleeve extending longitudinally between a distal end portion 106 furthest from the slips and a proximal end portion 108 closest to the slips. The distal end portion of the piston housing 96 has an interior diameter which is approximately equal to the outer diameter of the piston portion 102 of the piston received within the piston housing. An O-ring groove within the outer diameter of the piston portion 102 at the proximal end thereof provides a sealing connection between the piston and the surrounding distal end portion 106 of the piston housing 96 during relative sliding movement. The interior diameter of the piston housing is stepped in profile from the distal end portion 106 to the proximal end portion 108 which in turn has an interior diameter that closely matches the outer diameter of the inner housing 20. The piston cavity of the piston assembly is defined between the proximal end of the piston 94 and the internal shoulder at the stepped interior profile between the distal end portion 106 and the proximal end portion 108 of the piston housing such that the volume of the piston cavity increases as the piston housing 96 is displaced downwardly away from the piston 94 and towards the slips 26.

A plurality of fluid ports 110 extend radially through the boundary wall of the inner housing 22 in communication between the inner passage 22 within the interior of the inner housing and the piston cavity of the piston assembly at the exterior boundary of the inner housing. The fluid ports 110 are circumferentially spaced apart from one another in alignment with the proximal end of the piston 94 to remain in open communication with the piston cavity as the piston housing 96 moves between the stored and working positions of the apparatus. As the fluid cavity expands, the piston housing 96 and the upper cone sections 76 connected thereto by the retainer housing move together downwardly towards the lower cone sections while the outer housing remains freely movable along the inner housing to be self-centering relative to the upper and lower cone sections and the slips therebetween. Accordingly, the slips are engaged into the working position by hydraulic actuation. More particularly, hydraulic fluid is pumped into the inner passage of the tubing string so that the increase in fluid pressure communicates through the fluid ports 110 into the piston cavity to expand the piston cavity and displace the piston housing with the upper cone sections from the stored position to the working position.

To prevent actuation of the tubing anchor until a prescribed actuation pressure is reached, a set of actuating shear pins 112 are mounted at circumferentially spaced positions about the inner housing in operative connection between the piston housing 96 and the piston 94 received therein. The shear pins are specifically mounted through cooperating apertures in the distal end portion 106 of the piston housing 96 at the distal end thereof for alignment with corresponding mounting apertures for the shear pins within the piston portion 102 of the piston 94 in close proximity to the head 100 of the piston. The shear pins 112 thus mount the piston housing 96 fixed and immovably relative to the piston 94 in the stored position with the distal end of the piston housing in close proximity to the head 100 of the piston. The actuating shear pins 112 are arranged with a line weakness aligned with the shear plane between the piston 94 and the surrounding piston housing 96 such that shearing of the pins 112 at the shear plane results in the piston housing 96 being freely movable for longitudinal sliding along the inner housing relative to the piston 94. The actuating shear pins 112 define a prescribed overall shear resistance which prevents release of the piston housing from the stored position until a prescribed force is applied to the piston housing that exceeds the prescribed shear resistance. More particularly, the piston cavity is configured such that a prescribed force will act on the shear pins to shear the pins at the prescribed shear resistance when fluid pressure applied to the piston cavity fluid ports 112 meets the prescribed actuating fluid pressure that results in said prescribed force acting on the piston housing.

The retainer housing 98 that couples the upper cone sections 76 to the piston housing 96 includes an immediate body portion 114 extending longitudinally between the proximal end portion 116 connected to the distal ends of the upper cone sections 76 and a distal end portion 118 that mounts onto the proximal end of the piston housing 96. The distal end portion 118 has an inner diameter that fits over the outer diameter at the proximal end of the piston housing 96 and is threaded for cooperation with external threads on the piston housing to form a threaded connection between the retainer housing 98 and the piston housing 96.

The proximal end portion 116 of the retainer housing 98 is a ring that extends externally about the distal ends of the upper cone sections similarly to the proximal end of the retainer shearing 66. More particularly, the inner diameter of the proximal end portion fits over the outer diameter defined by the upper cone sections at the distal end thereof. Suitable ribs 120 extend radially inward from the inner surface of the proximal end portion to mate with the grooves 64 formed at the distal ends of the upper cone sections. The mating connection couples the upper cone sections for longitudinal sliding along the inner housing together with the retainer housing 98 and the piston housing connected thereto. The distal ends of the upper cone sections are bound in the radial direction between the outer surface of the inner housing 20 at the inner boundary and the surrounding proximal end portion 116 of the retainer housing at the outer boundary.

The intermediate portion 114 is stepped in profile along the inner diameter thereof such that the proximal end of the intermediate portion has an inner diameter approximately equal to the outer diameter of the inner housing to guide longitudinal sliding of the retainer housing 98 along the inner housing. The remaining distal end of the intermediate portion 114 is enlarged in inner diameter to receive a lock collar 122 between the intermediate portion 114 and the inner housing 22. The lock collar 122 forms part of a locking arrangement that allows free movement of the retainer housing in a first longitudinal direction from the stored position towards the working position, but prevents returning movement in an opposing second longitudinal direction from the working position of the upper cone sections to the initial stored position of the upper cone sections.

The lock collar 122 is a split ring that is generally C-shaped about the inner housing such that the gap in the circumference of the collar enables the overall circumference of the collar to be expanded and contracted relative to the inner housing. A series of annular ribs 124 are joined to one another along a continuous helical path to define an external thread on the lock collar. The external thread cooperates with a mating thread formed on the interior of the intermediate portion of the retainer housing in which the mating thread similarly comprises a series of annular ribs joined to one another along a continuous helical path to define an internal thread on the retainer housing 98.

Each outwardly protruding thread on the lock collar 122 has (i) a first face facing away from the slips which is oriented within the range of 85 to 90 degrees relative to the longitudinal axis so as to be near perpendicular to the longitudinal axis, and (ii) a second face 126 which faces towards the slips while being sloped at a prescribed slope to define a ramped face that is sloped radially outward while extending longitudinally away from the slips.

Each thread on the surrounding retainer housing similarly includes (i) a first face 128 facing towards the slips which is oriented within a range of 85 to 90° relative to the longitudinal axis so as to be near perpendicular to the longitudinal axis, and (ii) a second face 130 which faces away from the slips while being sloped at said prescribed slope to define a ramped face that is sloped radially outward while extending longitudinally away from the slips.

The inner surface of the lock collar 122 is also provided with a plurality of annular ribs 132 protruding inwardly from the inner surface and to define a texture suitable for gripping the inner housing. The inner housing 20 may also be provided with corresponding ribs protruding outward to form a corresponding texture for being gripped by the lock collar. In a normally un-flexed state of the lock collar, the inner diameter of the lock collar is such that the interior ribs 132 do not bite into the outer surface of the inner housing and pass over any texture or ribs that may be provided on the inner housing. More particularly, each rib 132 may have a proximal face nearest to the slips which is sloped in the longitudinal direction away from the slips while extending radially inward. In this manner the proximal faces are ramped for ease of sliding over the outer surface of the inner housing from the stored position to the working position.

In this manner, when fluid pressure within the inner passage reaches the activation pressure, the actuating shear pins 112 will sheer to cause the piston housing to be displaced from the store position towards the working position. In this instance, the flat first faces on the retainer housing engage the corresponding flat first faces 124 of the lock collar to urge the lock collar along the inner housing without substantially constricting the lock collar about the inner housing. The ramped proximal faces of the internal ribs 132 ensure that the lock collar readily slides along the inner housing towards the working position.

Alternatively, when forces act on the piston housing in a direction to displace the piston housing from the working position back to the stored position, the movement of the piston housing in the opposing second direction causes the second ramped faces 126 of the retainer housing to engage the corresponding second ramped faces on the lock ring. Due to the slope of the second faces being oriented in a range of 40 to 70 degrees from the longitudinal axis, longitudinal displacement of the retainer housing away from the slips applies a radially inward constricting force to the lock collar which causes the circumference of the lock collar to be reduced, which in turn causes the internal ribs 132 of the lock collar to bite into the exterior surface of the inner housing and restrict any further longitudinal displacement of the retainer housing away from the working position. The locking arrangement thus prevents the upper cone sections from being returned to the stored position once displaced into the working position thereof.

To release the tool from the working position, a user must instead apply upward force on the tubing string to overcome the prescribed holding force of the release shear pins so that the lower cone sections can instead be lowered along the inner housing and away from the upper cone sections and thereby enable the upper and lower cone sections to be separated for allowing the slips to return to a stored position within the interior of the outer housing 24.

In order to use the anchor apparatus 10, the apparatus is connected in line with a tubing string such that the inner passage of the inner housing 20 openly communicates with the corresponding longitudinal passage of the tubing string through which hydrocarbons are produced. The tubing string is then lowered into the wellbore casing while both sets of shear pins remain in a working configuration to hold the upper and lower cone arrangements separated from one another so that the slips are disengaged in the stored position. Once the tubing anchor is located at the appropriate depth, the anchor is set by raising the fluid pressure within the tubing string up to the activation pressure which causes the actuating shear pins to break and release the piston housing downwardly until the upper cone engages the slips. While maintaining the actuating fluid pressure, the upper cone arrangement continues to be displaced towards the lower cone arrangement while the surrounding outer housing 24 is displaced along the inner housing in a self-centering configuration by the slips being self-centering against the working faces of the upper and lower cone arrangements. The lock collar 122 is displaced along the inner housing 20 together with displacement of the upper cone sections into the working position. Once in the working position with the slips 26 engaging the outer casing 14 to anchor the tubing string relative to the casing, no further actuating fluid pressure is required due to the lock collar 122 that prevents the upper cone sections from backing off from the working position while the release shear pins prevent the lower cone sections from backing off from the working position.

The configuration of the lobes of the outer housing that receive respective portions of the segmented cone sections in the guideways of the outer housing provide a large annular flow space between the lobes in the circumferential direction to allow upward gas flow through the annulus or insertion of chemical injection lines or various communication lines alongside the tool within the annulus. When it is desired to release the anchor apparatus from the outer casing, an upward force is applied to the tubing string which exceeds the holding force of the release shear pins to cause the release shear pins to break. This in turn releases the lower cone sections such that the lower cone sections can slide downwardly from the working position. The downward sliding of the lower cone sections away from the upper cone sections causes a separation between the upper and lower cone sections which enable the slips to be biased back into a stored configuration under action of the spring members 92 to fully retract the slips 26 radially inward relative to the outermost portion of the lobes of the outer housing respectively. Continued upward pulling on the tubing string will withdraw the tubing string and the apparatus 10 from the wellbore.

To subsequently reuse the apparatus 10 both the actuating shear pins and the release shear pins are replaced with new unbroken pins so that the tool is again reset in the stored position.

In order to assemble the apparatus 10, the piston 94 is secured in place by sliding the piston overtop of the piston retainer ring 104 followed by attaching the top sub 38 so that the head 100 of the piston is longitudinally fixed between the retainer ring 104 and the top sub. The piston housing 96 can then be laid over top of the piston and mounted in place using the actuating shear pins 112. The lock collar 122 is then inserted over the inner housing in abutment with the proximal end of the piston housing 96. The retainer housing 98 then receives the upper cone sections mounted therein with the proximal ends of the upper cone sections being mounted in place within the outer housing before sliding these partly assembled components onto the inner housing 20. The lower cone sections are also installed within the bottom end of the outer housing and within the retainer shear ring 66 prior to mounting these components onto the inner housing by longitudinal sliding over the bottom end of the inner housing. Insertion onto the inner housing is sufficient to retain the upper and lower cone sections relative to the retainer housing 98 and the retainer ring 66 respectively. Once the assembled cone sections are inserted onto the inner housing and the distal end of the retainer housing is brought into close proximity to the lock collar 122, the retainer housing 98 is rotated as the retainer housing is further advanced towards the piston housing 96 to simultaneously thread the retainer housing 98 onto the piston housing 96 and thread the locking features of the retainer housing onto the locking features of the lock collar 122. The slips 26 may be initially installed within the outer housing 24 using temporary screws which hold the slips radially outward in the working position against the biasing of the spring. Removal of the temporary screws allows the slips to be biased inwardly into the stored position so that the sloped faces on the slips engage the corresponding working faces on the cone sections to bias the cone sections longitudinally apart from one another to the stored position. This aligns the retainer shear ring 66 with corresponding mounting sockets on the inner housing that receive the release shear pins therein to fix the lower cone arrangement relative to the inner housing in the stored position. Lastly, the lower sub 40 is mounted at the bottom end of the inner housing 20 to complete the assembly of the apparatus 10 such that the apparatus is ready for use downhole on a tubing string.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A tubing anchor apparatus for anchoring a tubing string relative to a surrounding casing in a wellbore, the apparatus comprising:

an inner housing having a through passage extending longitudinally between opposing ends of the inner housing, the opposing ends being configured for connecting the inner housing inline with the tubing string such that the through passage communicates with an inner passage of the tubing string;

a plurality of slips supported on the inner housing so as to be radially movable relative to the inner housing;

a first cone arrangement comprising a plurality first cone sections supported at circumferentially spaced positions about the inner housing in alignment with the plurality of slips respectively, each first cone section being fixed relative to the inner housing, and each first cone section having a working face which is sloped radially inwardly while extending in a first longitudinal direction towards the slips;

a second cone arrangement comprising a plurality of second cone sections supported at circumferentially spaced positions about the inner housing in alignment with the plurality of slips respectively, each second cone section having a working face which is sloped radially inwardly while extending in a second longitudinal direction towards the slips such that each slip is received longitudinally between a respective one of the first cone sections and a respective one of the second cone sections;

the second cone sections of the second cone arrangement being actuatable for displacement along the inner housing from a stored position at a first distance from the first cone sections of the first cone arrangement to a working position at a second distance from the first cone sections in which the second distance is less than the first distance;

the working faces of the first and second cone sections engaging respective first and second ends of the respective slips to displace the slips radially outward from the stored position defining a first overall diameter of the apparatus to the working position defining a second overall diameter of the apparatus, said second overall diameter being greater than said first overall diameter for gripping the casing in the working position; and an outer housing supported about the inner housing, the outer housing receiving the slips, the working faces of the first cone sections and the working faces of the second cone sections therein;

wherein the outer housing comprises (i) a sleeve portion arranged to be supported about the inner housing and (ii) a plurality of lobes protruding radially outwardly from the sleeve portion at circumferentially spaced apart positions about the sleeve portion; and wherein each lobe defines a longitudinal guideway receiving: (i) a respective one of the slips therein, (ii) the working face of the respective first cone section therein, and (iii) the working face of the respective second cone section therein.

2. The apparatus according to claim 1 wherein the cone sections of at least one of the first and second cone arrangements are fully segmented from one another as separate members which are circumferentially spaced apart from one another about the inner housing.

3. The apparatus according to claim 1 wherein the first cone sections are fixed relative to the inner housing by release shear pins having a prescribed shear resistance, the release shear pins being arranged to shear and release the first cone sections for longitudinal sliding relative to the inner housing upon application of a longitudinal force to the apparatus which exceeds the prescribed shear resistance of the release shear pins.

4. The apparatus according to claim 3 wherein the first cone arrangement is below the second cone arrangement, and wherein upon release of the release shear pins, the first cone sections are slidably downwardly away from the second cone arrangement in the working position.

5. The apparatus according to claim 1 wherein:

each guideway of the outer housing includes a pair of longitudinally opposed internal shoulder surfaces in which the working faces of the respective first and second cone sections are longitudinally contained between the opposed internal shoulder surface;

the opposed internal shoulder surfaces being spaced apart by a prescribed longitudinal direction enabling relative movement of the first and second cone sections between the stored position and the working position.

6. The apparatus according to claim 1 wherein the outer housing is longitudinally slidable relative to the inner housing.

7. The apparatus according to claim 1 wherein each slip is fully retracted radially relative to the respective lobe of the outer housing receive the slip therein in the stored position.

8. The apparatus according to claim 1 wherein each slip is operatively connected to a respective spring member supported under radial compression to bias the slip radially inwardly towards the stored position.

9. The apparatus according to claim 1 wherein the first cone arrangement is supported below the second cone arrangement, and wherein the second cone sections are slidably downwardly towards the first cone arrangement from said first distance in the stored position to said second distance in the working position.

10. The apparatus according to claim 1 further comprising:

a piston assembly supported externally about the inner housing and connected to the second cone sections such that the piston assembly and the second cone sections are movable together along the inner housing; and a lock collar operatively connected between the piston assembly and the inner housing, the lock collar enabling sliding movement of the piston assembly in a first direction corresponding to displacement of the second cone sections towards the first cone sections from the stored position to the working position, and the lock collar preventing sliding movement of the piston assembly in a second direction corresponding to displacement of the second cone sections away from the first cone sections from the working position towards the stored position.

11. The apparatus according to claim 10 wherein the lock collar comprises a split ring arranged to be constricted about the inner housing in response to displacement of the piston assembly away from the working position towards the stored position.

12. A tubing anchor apparatus for anchoring a tubing string relative to a surrounding casing in a wellbore, the apparatus comprising:

an inner housing having a through passage extending longitudinally between opposing ends of the inner housing, the opposing ends being configured for connecting the inner housing inline with the tubing string such that the through passage communicates with an inner passage of the tubing string;

a plurality of slips supported on the inner housing so as to be radially movable relative to the inner housing;

a first cone arrangement comprising a plurality first cone sections supported at circumferentially spaced positions about the inner housing in alignment with the plurality of slips respectively, each first cone section being fixed relative to the inner housing, and each first cone section having a working face which is sloped radially inwardly while extending in a first longitudinal direction towards the slips;

a second cone arrangement comprising a plurality of second cone sections supported at circumferentially spaced positions about the inner housing in alignment with the plurality of slips respectively, each second cone section having a working face which is sloped radially inwardly while extending in a second longitudinal direction towards the slips such that each slip is received longitudinally between a respective one of the first cone sections and a respective one of the second cone sections;

wherein the second cone sections of the second cone arrangement are actuatable for displacement along the inner housing from a stored position at a first distance from the first cone sections of the first cone arrangement to a working position at a second distance from the first cone sections in which the second distance is less than the first distance;

wherein the working faces of the first and second cone sections engage respective first and second ends of the respective slips to displace the slips radially outward from the stored position defining a first overall diameter of the apparatus to the working position defining a second overall diameter of the apparatus, said second overall diameter being greater than said first overall diameter for gripping the casing in the working position;

wherein the first cone sections are fixed relative to the inner housing by release shear pins having a prescribed shear resistance, the release shear pins being arranged to shear and release the first cone sections for longitudinal sliding relative to the inner housing upon application of a longitudinal force to the apparatus which exceeds the prescribed shear resistance of the release shear pins; and wherein the first cone sections are connected to one another by a retainer shear ring supported about the inner housing for longitudinal sliding along the inner housing, the release shear pins being mounted between the retainer shear ring and the inner housing to fix the first cone sections relative to the inner housing.

13. A tubing anchor apparatus for anchoring a tubing string relative to a surrounding casing in a wellbore, the apparatus comprising:

an inner housing having a through passage extending longitudinally between opposing ends of the inner housing, the opposing ends being configured for connecting the inner housing inline with the tubing string such that the through passage communicates with an inner passage of the tubing string;

a plurality of slips supported on the inner housing so as to be radially movable relative to the inner housing;

a first cone arrangement comprising a plurality first cone sections supported at circumferentially spaced positions about the inner housing in alignment with the plurality of slips respectively, each first cone section being fixed relative to the inner housing, and each first cone section having a working face which is sloped radially inwardly while extending in a first longitudinal direction towards the slips;

a second cone arrangement comprising a plurality of second cone sections supported at circumferentially spaced positions about the inner housing in alignment with the plurality of slips respectively, each second cone section having a working face which is sloped radially inwardly while extending in a second longitudinal direction towards the slips such that each slip is received longitudinally between a respective one of the first cone sections and a respective one of the second cone sections;

wherein the second cone sections of the second cone arrangement are actuatable for displacement along the inner housing from a stored position at a first distance from the first cone sections of the first cone arrangement to a working position at a second distance from the first cone sections in which the second distance is less than the first distance;

wherein the working faces of the first and second cone sections engage respective first and second ends of the respective slips to displace the slips radially outward from the stored position defining a first overall diameter of the apparatus to the working position defining a second overall diameter of the apparatus, said second overall diameter being greater than said first overall diameter for gripping the casing in the working position; and wherein the second cone sections are connected to one another by a retainer ring supported about the inner housing for longitudinal sliding along the inner housing.

14. The apparatus according to claim 13 wherein each second cone section includes a distal end longitudinally opposed from the working face of the second cone section, the retainer ring extending externally about the distal ends of the second cone sections.

15. The apparatus according to claim 13 further comprising a piston assembly supported externally about the inner housing and including said retainer ring connecting the second cone sections such that the piston assembly and the second cone sections are movable together along the inner housing, wherein the piston assembly defines a fluid cavity therein in fluid communication with the through passage of the inner housing, and wherein the fluid cavity of the piston assembly expands as the second cone sections are displaced with the piston assembly from the stored position to the working position whereby the piston assembly is hydraulically actuated by pressurized fluid in the through passage of the inner housing.

16. The apparatus according to claim 15 wherein the piston assembly is fixed relative to the inner housing in the stored position by actuating shear pins having a prescribed shear resistance, the actuating shear pins being arranged to shear and release the piston assembly from the stored position for longitudinal sliding relative to the inner housing upon application of a prescribed fluid pressure to the through passage of the inner housing which exceeds the prescribed shear resistance of the actuating shear pins.

17. A tubing anchor apparatus for anchoring a tubing string relative to a surrounding casing in a wellbore, the apparatus comprising:

an inner housing having a through passage extending longitudinally between opposing ends of the inner housing, the opposing ends being configured for connecting the inner housing inline with the tubing string such that the through passage communicates with an inner passage of the tubing string;

a plurality of slips supported on the inner housing so as to be radially movable relative to the inner housing;

a first cone arrangement comprising a plurality first cone sections supported at circumferentially spaced positions about the inner housing in alignment with the plurality of slips respectively, each first cone section being fixed relative to the inner housing, and each first cone section having a working face which is sloped radially inwardly while extending in a first longitudinal direction towards the slips;

a second cone arrangement comprising a plurality of second cone sections supported at circumferentially spaced positions about the inner housing in alignment with the plurality of slips respectively, each second cone section having a working face which is sloped radially inwardly while extending in a second longitudinal direction towards the slips such that each slip is received longitudinally between a respective one of the first cone sections and a respective one of the second cone sections;

the second cone sections of the second cone arrangement being actuatable for displacement along the inner housing from a stored position at a first distance from the first cone sections of the first cone arrangement to a working position at a second distance from the first cone sections in which the second distance is less than the first distance;

the working faces of the first and second cone sections engaging respective first and second ends of the respective slips to displace the slips radially outward from the stored position defining a first overall diameter of the apparatus to the working position defining a second overall diameter of the apparatus, said second overall diameter being greater than said first overall diameter for gripping the casing in the working position;

a piston assembly supported externally about the inner housing and connected to the second cone sections such that the piston assembly and the second cone sections are movable together along the inner housing; and a lock collar operatively connected between the piston assembly and the inner housing, the lock collar enabling sliding movement of the piston assembly in a first direction corresponding to displacement of the second cone sections towards the first cone sections from the stored position to the working position, and the lock collar preventing sliding movement of the piston assembly in a second direction corresponding to displacement of the second cone sections away from the first cone sections from the working position towards the stored position;

wherein the lock collar comprises a split ring arranged to be constricted about the inner housing in response to displacement of the piston assembly away from the working position towards the stored position; and wherein the lock collar comprises at least one annular member protruding radially from the split ring, said at least one annular member having a ramped surface that is sloped longitudinally away from the first cone sections as the ramped surface extends radially outward, the ramped surface of said at least one annular member being arranged to cooperate with a corresponding ramped surface on the piston assembly such that relative sliding movement between the ramped surface on said at least one annular member and the corresponding ramped surface on the piston assembly acts to constrict the split ring about the inner housing to lock the piston assembly relative to the inner housing in response to displacement of the piston assembly away from the working position towards the stored position.

18. The apparatus according to claim 17 wherein said at least one annular member comprises a helical thread extending about the split ring and wherein a corresponding thread is provided on the piston assembly in threaded connection with the helical thread in which said corresponding ramped surface is defined on the corresponding thread on the piston assembly.

* * * * *